United States Patent [19]

Theiler

[11] 4,233,762

[45] Nov. 18, 1980

[54] IRONING MACHINE

[76] Inventor: Robert Theiler, L'Orée du bois, F-68360 Soultz, France

[21] Appl. No.: 4,912

[22] Filed: Jan. 18, 1979

[30] Foreign Application Priority Data

Jan. 24, 1978 [CH] Switzerland ..... 722789/78

[51] Int. Cl.[2] ..... D06F 69/02

[52] U.S. Cl. ..... 38/8; 38/9

[58] Field of Search ..... 38/8, 9, 11, 14, 44, 38/49, 50, 51, 144

[56] References Cited

U.S. PATENT DOCUMENTS

| | | | |
|---|---|---|---|
| 2,368,652 | 2/1945 | Forse | 38/9 |
| 3,510,971 | 5/1970 | Bravetti | 38/8 |

FOREIGN PATENT DOCUMENTS

| | | |
|---|---|---|
| 92696 | 5/1923 | Austria . |
| 61489 | 3/1892 | Fed. Rep. of Germany . |
| 199707 | 6/1908 | Fed. Rep. of Germany . |
| 471884 | 11/1914 | France . |
| 1113988 | 4/1956 | France . |
| 1385543 | 12/1964 | France . |
| 361155 | 11/1931 | United Kingdom . |
| 689639 | 4/1953 | United Kingdom . |

*Primary Examiner*—Louis Rimrodt
*Attorney, Agent, or Firm*—Werner W. Kleeman

[57] ABSTRACT

An ironing machine having two rolls whose axes extend essentially horizontally and are disposed in a common, substantially vertical plane. The rolls can be rotated in opposite rotational directions by means of a drive device. For each roll there are provided two heating elements arranged at different sides of the aforementioned plane. The heating elements have heating surfaces of arcuate cross-sectional configuration. These heating surfaces heating the textile pieces during operation of the ironing machine and pressing such against the rolls. Transport bands or belts serve to guide and transport the textile pieces in such a manner that initially they travel about one and thereafter about the other roll and, thus, follow a predetermined transport path substantially in the form of a figure eight through the ironing machine.

7 Claims, 2 Drawing Figures

IRONING MACHINE

BACKGROUND OF THE INVENTION

The present invention relates to a new and improved construction of ironing machine for ironing various types of textile pieces or garments or the like, hereinafter simply broadly referred to as textile pieces.

The ironing machine of the present invention is of the type comprising a frame and superimposed rolls having drive means which rotate the rolls which are arranged above one another in opposite rotational sense. Further, heating elements are provided which have a heating surface serving for heating and pressing or ironing the textile pieces, each such heating surface having an arcuate-shaped cross-sectional configuration and extending in a work position at least approximately coaxially with respect to the lengthwise axis of the related roll. An intermediate space is present between the superimposed rolls and related heating elements. Transport bands or belts are arranged in the intermediate space in such a fashion that the textile pieces are successively transported from one roll to the other roll. There are also provided means which infeed the textile pieces at one side of a vertical plane extending parallel to the roll axes to the rolls, and means which transport the textile pieces, after the same have past the rolls, to the other side of the vertical plane away from the rolls.

In an ironing machine of this type, known to the art from German Pat. No. 199,707, there are provided six rotatably mounted rolls. The axes of each three respective rolls are located in a respective horizontal plane, and the rolls are arranged in pairs above one another. Beneath each roll there is disposed a substantially trough-shaped heating element having at its upper side a heating surface which, in cross-section, extends approximately through one-quarter of a circle. Between the heating elements associated with the upper row of rolls and the lower row of rolls there is provided an intermediate space. The rolls are guided to be vertically displaceable at the frame of the ironing machine and can be raised and lowered by means of an adjustment element. When the rolls are lowered and located in their work or operative position, then, the heating surfaces which in cross-section extend through approximately one-quarter of a circle, are located at least approximately coaxially with respect to the roll axes. The heating elements operatively associated with the rolls located in the same plane as constructed in such a manner that they form mutually abutting slide surfaces for the textile pieces. Moreover, the lower rolls, during operation, are rotated in opposite rotational sense with respect to the upper rolls. The textile pieces which are to be ironed are infed at one end of the upper row of rolls and then transported by the rolls over the curved or arcuate-shaped heating surfaces of the heating elements to the other end of the upper row of rolls. At that location the textile pieces arrive at a conveyor belt or band and are transported by such through the intermediate space provided between the heating elements belonging to the upper roll row and the lower roll row to one end of the lower roll row. Thereafter, the textile pieces are transported through the lower rolls over the curved heating surfaces. When the textile pieces have passed the lower roll row they are again entrained by a conveyor band or belt and transported to the exit side or outlet of the ironing machine.

With this state-of-the-art ironing machine the curved heating surfaces of the heating elements, at any point in time, are thus located only approximately over one-quarter of the entire roll circumferential surface. On the other hand, the remaining three-quarters of the roll circumferential surface are not utilized for ironing, but nonetheless participate in delivering energy to the surroundings. This heretofore known machine thus utilizes a great deal of energy in comparison to the attained ironing efficiency. Since the prior art machine is provided with six rolls it is relatively expensive to manufacture. Additionally, it automatically has a large spatial extent and requires, in the area where it is erected, a relatively large floor surface.

From Austrian Pat. No. 92,696 there is known an ironing machine which has two rolls, each of which has operatively associated therewith a respective heating element. Furthermore, there are provided conveyor bands or belts in order to transport the textile pieces between the rolls and the heating surfaces of the heating elements. Also with this construction of ironing machine the sections of the heating surfaces of the heating elements which extend coaxially with respect to the roll axes only extend approximately over one-quarter of the entire roll circumferential surface. Therefore, during operation of this prior art ironing machine there also exist considerable thermal losses. Additionally, this state-of-the-art ironing machine, if the roll diameter is not structured to be extremely large, only has a relatively modest ironing efficiency or capability, and thus, only renders possible relatively small working speeds, and furthermore, there can only be obtained relatively poor ironing of the textile pieces or the like.

In German Pat. No. 61,489 there is taught to the art a press for pressing or ironing textiles. The press possesses a cylinder and two heating elements arranged to both sides of such cylinder. Between the heating elements and the cylinder there are guided therethrough conveyor bands or belts for transporting the textile pieces which are to be pressed or ironed. The heating elements are displaceable at right angles to the geometric axis of the cylinder. The cylinder itself is retained at its ends in upwardly open recesses of the frame. When the heating elements are displaced away from the cylinder the latter can be upwardly raised. During operation of the press the cylinder is apparently not rotated. Furthermore, it appears that the transport and the pressing of the textile pieces is not accomplished at the same time, rather alternately. This means that the textile pieces which are to be pressed or ironed, with the heating elements slightly displaced away from the cylinder, are transported between the heating elements and the cylinder, then pressed at such time as the conveyor belts are not in motion, and finally, can be transported away. This state-of-the-art press therefore likewise only allows for small operating speeds, and the obtained ironing effect of the textile pieces is relatively poor. Additionally, this heretofore known machine, notwithstanding the fact that it only utilizes a single cylinder, requires a relatively large amount of space. Among other reasons that is so because the conveyor belts which travel between the heating surfaces of the heating elements and the cylinder travel completely about the displaceable heating elements. Thus, in comparison to its pressing or ironing efficiency this heretofore known machine requires a relatively large amount of space and, furthermore, fabrication thereof is additionally quite complicated. A further disadvantage resides in the fact that during passage of the textile pieces through the machine both of the heating elements bear at the same side of the textile pieces, so that there is not realized the same ironing effect at both sides of the textile pieces.

SUMMARY OF THE INVENTION

Therefore, with the foregoing in mind it is a primary object of the present invention to provide a new and improved construction of ironing machine which is not associated with the aforementioned drawbacks and limitations of the prior art constructions.

Another and more specific object of the present invention aims at the provision of a new and improved construction of ironing machine which produces a large ironing efficiency or capability and utilizes a relatively large amount of the supplied thermal energy for ironing.

Yet a further significant object of the present invention aims at devising an ironing machine which can be fabricated at low cost.

Another important object of the invention is to construct the ironing machine so as to possess a compact construction, in order to be able to maintain small the thermal losses, and thus, to be able to erect and operate the machine within a relatively small amount of space.

Now in order to implement these and still further objects of the invention, which will become more readily apparent as the description proceeds, the invention contemplates providing an ironing machine of the type known from the aforementioned German Pat. No. 199,707, which is improved upon by the features that there are only provided two rolls and for each of these two rolls there are provided two heating elements located at different sides with respect to the roll axes. Further, for each roll there is provided at least one transport band which trains about the related roll, so that the textile pieces, during operation of the ironing machine, can be transported about the angular region or circumferential extent of the rolls which is covered or spanned by the pair of heating elements.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
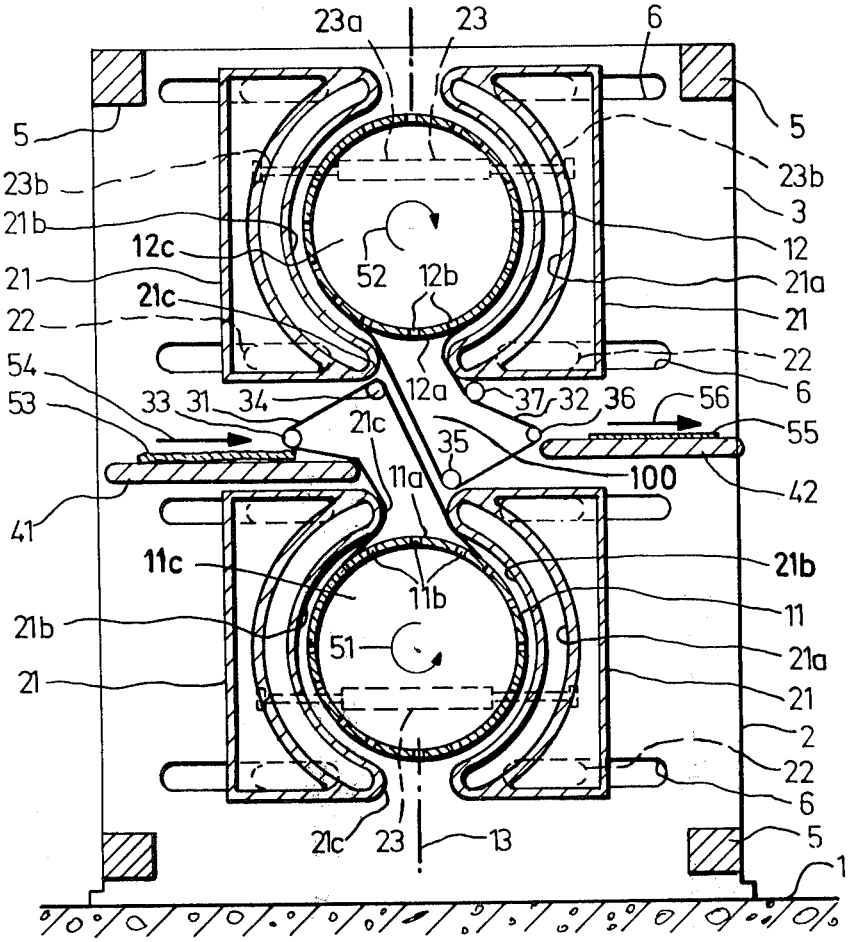
FIG. 1 illustrates a schematic vertical sectional view through an ironing machine of the invention.
Figure 2:
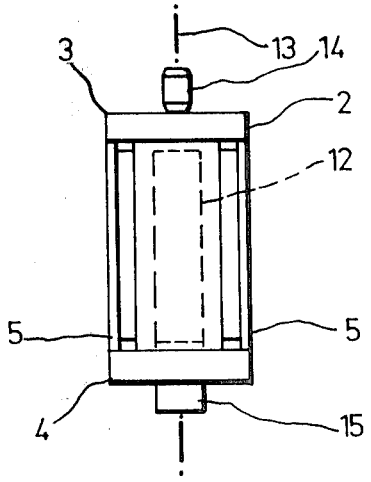
FIG. 2 is a top plan view, on a reduced scale, of the ironing machine shown in FIG. 1.

Describing now the drawings, the exemplary embodiment of ironing machine illustrated in FIGS. 1 and 2 will be seen to comprise a frame or housing 2, shown in a markedly simplified manner, which reposes upon a floor 1 or other supporting surface. This frame 2 is formed by two essentially vertical side elements 3 and 4 and the cross ties or traverses 5 which interconnect such side elements 3 and 4.

Rotatably mounted in the frame 2 are two substantially hollow cylindrical rolls 11 and 12, likewise shown in simplified form, and specifically, a first roll or roller 11 and a second roll or roller 12. Both of the rotatable rolls 11 and 12 have rotational axes which are essentially in parallelism to one another and located in a common, vertical central plane 13 in the embodiment under discussion. Yet, as will be explained hereinafter this arrangement is not absolutely necessary in all instances. The outer surface or jacket 11*a* and 12*a* of both rolls 11 and 12, respectively, and which outer surfaces 11*a* and 12*a* are formed of metal, are provided with throughpass holes or bores 11*b* and 12*b*, respectively, essentially uniformly distributed over the entire jacket surface of the related roll 11 and 12. At both end faces of each of the rolls 11 and 12 there is provided in any suitable manner a tight closure or seal of the respective internal space or compartment 11*c* and 12*c* of the rolls 11 and 12. The outer surfaces or jackets 11*a* and 12*a* of the rolls 11 and 12 are each externally provided with a conventional and therefore not particularly illustrated deformable, porous, air and vapor pervious sleeve which, for instance, can be formed by a so-called "Molton". These sleeves have been conveniently omitted from the drawings to improve the illustration and comprehensibility of the showing. The internal diameter of each sleeve is somewhat larger than the external diameter of the related outer surface or jacket and can be outwardly biased by elastic tensioning elements, for instance compression springs.

Now at the side element 3 of the frame or housing 2 there is secured an electric drive motor 14 which in conjunction with an appropriate transmission or gearing and operating elements provided at the hollow side element 3 form the drive device or drive means for rotating the rolls 11 and 12. At the side element 4 there is provided for each roll 11 and 12 a suction device 15 which is operatively connected by means of any suitable sealed rotational connection with the hollow space or compartment 11*c* and 12*c* of the related roll 11 and 12.

Furthermore, the ironing machine of the invention will be seen to comprise four heating elements or heating means 21. These heating elements 21 are displaceably guided for movement horizontally and at right angles to the longitudinal axes of the rolls 11 and 12 by means of guide elements 22 in guides 6 of the side element 3 and corresponding guides or guide slots of the side element 4. By means of adjustment elements 23, which may comprise a non-displaceable fluid operated, typically for instance pneumatic or hydraulic piston-and-cylinder units 23*a*, secured at the side element 3, it is possible to displace the heating elements 21 along the guides or guide slots 6 and to arrest such in desired position. The piston rods or shafts 23*b* of the piston-and-cylinder units 23*a* are fixedly connected with the related heating elements 21 to enable such displacement movements to be accomplished. Each of both rolls 11 and 12 has operatively associated therewith two of the aforementioned heating elements 21. Each such two coacting heating elements 21 is located to different sides of the central plane 13 and is arranged substantially symmetrically with respect thereto. The second roll 12 and both of the heating elements 21 operatively associated therewith are separated by an intermediate space 100 from the first roll 11 and the heating elements 21 operatively related to such first roll 11.

The heating elements 21 possess sealed hollow compartments or spaces 21*a* which are structured in the form of approximately serpentine-shaped extending passages for a hot fluid medium and provided with not particularly shown infeed and outfeed connections or lines. These connections are operatively connected with a vapor, water or oil heater, so that the heating elements 21 can be heated by vapor, water or oil, as desired. An arrangement suitable for this purpose has been disclosed in my copending United States application Ser. No. 4738, filed Jan. 18, 1979, entitled "Ironing Installation And Method of Operating The Same", to which reference may be readily had and the disclosure of which is incorporated herein by reference. The walls of the heating elements 21 which confront the related rolls 11 and 12 form the heating surfaces **21*b*. These heating surfaces 21*b* form essentially part of a circular cylindrical surface, and thus, in cross-section are of circular or arcuate-shaped configuration. The axes of the heating surface-circular cylinder extend essentially parallel to the roll axes. If the heating elements 21 are located in the work position, shown in FIG. 1, then the axes of the heating surface-circular cylinder coincide at least approximately with the roll axes. Stated in another way: if the heating elements 21 are in their work position, then the heating surfaces 21*b* extend approximately coaxially with respect to the rolls 11 and 12 and their longitudinal axes. The heating surfaces 21*b* extend over a sector angle in the order of between about 120° and 170° and can amount to, for instance, 140°. At the edges of the heating surfaces 21*b* which extend essentially parallel to the roll axes there are formed rounded transition surfaces 21*c*. The walls of the heating elements 21 which confront the rolls 11 and 12** are insulated towards the outside by any suitable, but not particularly illustrated thermal insulating means.

The first, lower roll 11 is trained by narrow, essentially mutually parallely extending first transport bands or belts 31 which are separated from one another by intermediate spaces. The second, upper roll 12 is correspondingly trained by second transport bands or belts 32. The first and second transport bands 31 and 32 are trained about the related first and second rolls 11 and 12 through a sector angle amounting to about 300°. At the confronting sides of both rolls 11 and 12 the transport bands 31 and 32, respectively, do not bear against the related rolls 11 and 12 and are guided by means of guide rolls 33, 34 and 35, 36, 37, respectively, in such a manner that they extend through the intermediate space which is present between both rolls 11 and 12 and the related heating elements 21. At the region of the intermediate space 100 between the lower and upper heating elements 21 there is provided to both sides of the vertical central plane 13 a respective support member 41 and 42. The support member 41, located to the left of the central plane 13 in the showing of FIG. 1, forms the support and slide surface for the textile pieces to be ironed and which are to be infed, reference character 53 designating one such textile piece. The other support member 42 forms the support and slide surface for the ironed textile pieces, reference character 55 designating one such ironed textile piece.

Having now had the benefit of the foregoing discussion there will be considered the mode of operation of the described ironing machine which is as follows:

During operation of the ironing machine, the heating elements 21 are located in their work position shown in FIG. 1 of the drawings. As previously explained, there is infed to the internal spaces or compartments **21*a* of the heating elements 21 superheated steam or hot water or oil, so that the heating surfaces 21*b* are heated. Both of the rolls 11 and 12 are rotated by the drive device or drive means incorporating the electric drive motor 14 at the same rotational speed, but in opposite rotational sense, so that the roll 11 rotates in the direction of the arrow 51 and the roll 12 in the direction of the arrow 52. The transport bands or belts 31 move in the same rotational sense as the roll 11 and the other transport bands or belts 32 in the same rotational sense as their related roll 12**.

Now if a textile piece 53 or the like is placed upon the support member or support means 41 and manually shifted in the direction of the arrow 54 towards the central plane 13, then it is engaged by those sections of the transport bands 31 which are located between the guide roll 33 arranged above the support member 41 and the upper rounded or curved portion **21*c* of the left-hand, lower arranged heating element 21. The textile piece then arrives between the roll 11 and the heating surface 21*b* of the left, lower-hand heating element 21. As already explained, the rolls 11 and 12 are each equipped with a not particularly shown sleeve which is pressed by springs or the like towards the outside. If no textile piece is located between one of the rolls and its related heating surface 21*b*, then the sleeve operatively associated with such roll and the section of the transport bands enclosing such sleeve bear against the corresponding heating surface. A textile piece which is dispositioned between one of the rolls and the related heating surface is thus heated by such heating surface 21*b* and equally pressed against the roll 11. Hence, the heating elements 21** thus serve both as pressure and pressing or ironing elements.

During rotation of the roll 11 the textile piece now is further transported and arrives between the roll 11 and the heating surface **21*b* of the heating element 21 located at the right-hand, lower side of FIG. 1**, where it is again further heated and pressed.

By the action of the section of the transport bands 31 located between the roll 11 and the guide roll 34 the textile piece, after it has traveled over the roll 11 through a sector angle of about 300°, is upwardly transported away by the roll 11 towards the other roll 12. In carrying out this movement the textile piece comes into contact with the transport bands or belts 32 which extend between the guide roll 35 and the lower edge **21*c* of the heating surface 21*b* of the heating element 21 located at the top left of the showing of FIG. 1, and such entrained textile piece travels for a certain distance extensively parallel to the transport bands 31. The transport bands 31 are downwardly deflected at the region of the guide roll 34 which is disposed at the neighborhood of the lower edge of the heating surface 21*b* of the upper left-hand arranged heating element 21, and the guide roll 34 is arranged in such a manner that a textile piece disposed between the transport or conveyor bands 31 and 32 is further transported upwardly and arrives between the roll 12 and the heating surface 21*b* of the upper left-hand arranged heating element 21**.

The textile piece is now transported by the roll 12 and the transport bands 32 trained about such roll 12, along the heating surface **21*b* of the upper left-hand arranged heating element 21 in an upward direction. Thereafter, such textile piece is transported downwardly along the heating surface 21*b* of the heating element 21 arranged at the right-hand side of the showing of FIG. 1. Consequently, the textile piece is again heated and pressed flat. At the lower heating surface edge of the upper right-hand arranged heating element 21 the textile piece is transported by the transport bands or belts 32 downwardly away from the roll 12 onto the support member or support means 42, where it assumes the position of the illustrated textile piece 55 and can be removed in the direction of the arrow 56** out of the ironing machine.

As will be apparent from the previous description and the illustration of the ironing machine of FIG. 1, the textile pieces can be infed to the ironing machine at one side of the vertical central plane 13 extending through the roll axes and can be removed at the other side of the central plane 13 from the ironing machine. The operator thus is afforded the possibility of infeeding and removing the textile pieces in a relatively effortless manner.

As will also be apparent from the previous discussion, the textile pieces move along a path of travel which approximately describes a figure eight. Consequently, the textile pieces completely travel about both of the rolls 11 and 12, but only bear at each roll over a sector angle of about 300°.

The textile pieces are infed in a moist condition for ironing. Upon heating the textile pieces there is thus formed water vapor. This water vapor is sucked-up by means of the suction device 15, into the inner compartments or chambers 11*c* and 12*c* of the rolls 11 and 12, respectively, through the porous sleeves of the rolls 11 and 12 and through the holes or bores 11*b* and 12*b* provided at the roll shells or surfaces 11*a* and 12*a*, respectively. By means of the suction device 15 such water vapor is then removed towards the outside, as have been more fully explained in the aforementioned copending United States application Ser. No. 4738, filed Jan. 18, 1979. The suction device 15 generates a negative pressure in the internal compartments 11*c* and 12*c* of the rolls 11 and 12, respectively, so that also air can be sucked into the aforementioned internal compartments of the rolls 11 and 12 and the textile pieces are drawn against such rolls during their passage through the ironing machine.

If it is necessary to clean the ironing machine, particularly the heating surfaces 21*b*, then heating elements 21 can be shifted away from the rolls 11 and 12 by means of the adjustment elements 23 along the guides or guide slots 6.

Finally, it is mentioned that it is possible to modify the exemplary illustrated embodiment of ironing machine in a number of different ways. For instance, the adjacent, spaced moving transport bands or belts 31 can be replaced by a single wide band or belt having throughpass openings or the like for the vapor. The same modification can also be made for the transport bands or belts 32. Additionally, it is possible to replace the support members 41 and 42 by suitable conveyor or transport bands which infeed the textile pieces to the transport bands 31 and again remove the textile pieces from the transport bands 32. Further, the transport bands or belts can be guided in such a manner that the textile piece, after infeeding the same, initially travel about the upper roll and thereafter about the lower roll.

With the described exemplary embodiment there is provided both at the top and bottom an intermediate space or gap between the heating elements arranged at different sides of the rolls when such heating elements are in their work position. It would be however possible to design the heating elements such that they at least approximately adjoin or abut one another at the roll sides facing away from one another, i.e., below the roll 11 and above the roll 12. Moreover, it is not absolutely necessary to provide rounded or curved portions 21*c* at the heating surface edges which are disposed at the sides of the rolls which face away from one another.

Equally, it is not absolutely necessary to arrange the roll axes so as to lie in a common essentially vertical plane. The rolls can be arranged above one another, i.e., in a superimposed fashion, but can be slightly shifted in horizontal direction so as to assume an offset positioning.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An ironing machine for ironing textile pieces comprising:

frame means;

only one pair of rolls arranged above one another at said frame means;

drive means for rotating said rolls in an opposite rotational sense;

heating means for heating the textile pieces;

said heating means possessing for each roll a heating surface serving to heat and iron the textile pieces;

each said heating surface possessing in cross-section a substantially arcuate-shaped configuration;

each of said rolls having a roll axis;

said arcuate-shaped heating surfaces, when said heating means assume a work position, extending at least approximately coaxially with respect to the roll axis of the related roll;

said rolls which are arranged above one another and the related heating means for each said roll being dispositioned such that an intermediate space is formed between the rolls and the related heating elements;

transport band means arranged in said intermediate space such that the textile pieces are successively transported from one roll to the other roll;

means for transporting the textile pieces at one side of a substantially vertical central plane through the rolls to the rolls;

means for removing the textile pieces, after having past the rolls, from the other side of the vertical central plane away from the rolls;

said heating means comprising a pair of heating elements for each roll;

said heating elements of each roll being arranged to opposite sides of the related roll with respect to the roll axis;

said transport band means comprising for each roll at least one separate transport band which is trained about a major portion of the circumference of such roll, so that the textile pieces, during operation of the ironing machine, are transported about at least the circumferential region of each roll which is spanned by the related pair of heating elements;

means for guiding and deflecting the transport bands of each of the rolls such that said transport band of one roll has a band portion which is deflected in said intermediate space in the direction of a deflected band portion of the transport band of the other roll; and said deflected band portions of said transport bands of said two rolls defining therebetween a transport and transfer path for the textile pieces so that said transport bands transfer at said transfer path the textile pieces from one roll, where the textile pieces bear at one face against the heating surface of the heating means of said one roll, to the other roll where the textile pieces bear with their other opposite face against the heating surface of the heating means of the other roll, so that said textile pieces are ironed at both opposite faces thereof.

2. The ironing machine as defined in claim 1, wherein:

the heating elements related to each roll are arranged at different sides of a vertical plane extending through the roll axes.

3. The ironing machine as defined in claim 2, wherein:

said frame means is provided with guide means for displaceably guiding the heating elements of each roll at essentially right angles to the roll axis of the related roll; and adjustment means provided for said heating elements in order to adjust said heating elements along said guide means.

4. The ironing machine as defined in claim 1, wherein:

said frame means is provided with guide means for displaceably guiding the heating elements of each roll at essentially right angles to the roll axis of the related roll; and adjustment means provided for said heating elements in order to adjust said heating elements along said guide means.

5. The ironing machine as defined in claim 1, wherein:

said deflected band portions of said transport bands contain at the region of said intermediate space essentially parallel band sections between said rolls for forming said transfer path.

6. The ironing machine as defined in claim 1, wherein:

said one roll defines a lower roll; and an essentially horizontally arranged support table located between said two rolls for infeeding the textile pieces to the transport band of said lower roll.

7. The ironing machine as defined in claim 1, wherein:

a plurality of said transport bands are trained about a related one of each of said rolls.

* * * * *